US011578957B2

(12) United States Patent
Willits et al.

(10) Patent No.: US 11,578,957 B2
(45) Date of Patent: Feb. 14, 2023

(54) SPINNING PROJECTILE ORIENTATION TRACKING

(71) Applicant: BAE Systems Information and Electronic Systems Integration Inc., Nashua, NH (US)

(72) Inventors: John T. Willits, Pflugerville, TX (US); Sachin N. Dekate, Austin, TX (US); Gary L. Viviani, Bastrop, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 337 days.

(21) Appl. No.: 16/887,724

(22) Filed: May 29, 2020

(65) Prior Publication Data

US 2021/0285747 A1 Sep. 16, 2021

Related U.S. Application Data

(60) Provisional application No. 62/988,678, filed on Mar. 12, 2020.

(51) Int. Cl.

| | |
|---|---|
| ***F42B 10/64*** | (2006.01) |
| ***F41G 7/30*** | (2006.01) |
| ***F42B 10/26*** | (2006.01) |
| ***F42B 30/00*** | (2006.01) |
| *F42B 10/00* | (2006.01) |

(52) U.S. Cl.

CPC ..... *F42B 10/64* (2013.01); *F41G 7/305* (2013.01); *F42B 10/26* (2013.01); *F42B 30/006* (2013.01)

(58) Field of Classification Search

CPC ..... F42B 10/64; F42B 10/26; F42B 30/006; F41G 7/305

See application file for complete search history.

(56) References Cited

U.S. PATENT DOCUMENTS

| | | | | |
|---|---|---|---|---|
| 5,478,028 | A * | 12/1995 | Snyder | F41G 7/305 244/3.22 |
| 2005/0184192 | A1* | 8/2005 | Schneider | F41G 7/305 244/3.1 |
| 2010/0220002 | A1* | 9/2010 | Rastegar | F41G 7/305 342/62 |
| 2010/0237184 | A1* | 9/2010 | Frey, Jr. | F41G 7/305 244/3.11 |
| 2012/0199690 | A1* | 8/2012 | Rastegar | F41G 7/305 342/362 |

FOREIGN PATENT DOCUMENTS

| | | | | |
|---|---|---|---|---|
| GB | 2301724 | A * | 12/1996 | F41G 7/305 |

* cited by examiner

*Primary Examiner* — Bernarr E Gregory
(74) *Attorney, Agent, or Firm* — Sand, Sebolt & Wernow LPA; Gary McFaline

(57) ABSTRACT

A method includes determining a rotational position of a rotating projectile as a function of an orientation of a sensor on the rotating projectile. The method also includes actuating a steering mechanism on the rotating projectile at the determined rotational position. The method also includes altering the trajectory of the rotating projectile.

19 Claims, 5 Drawing Sheets

18 – Camera Assembly
20 – Command Transmitter

26 – Sensor
28 – Receiving Element
30 – Operational Amplifier
32 – Logic

28 – Receiving Element
30 – Operational Amplifier
32 – Logic
32A – Frequency Multiplier Unit
32B – Counter
32C – Comparator
34 – Steering Mechanism

SPINNING PROJECTILE ORIENTATION TRACKING

CROSS REFERENCE TO RELATED APPLICATIONS

This application claims the benefit of U.S. Provisional Application Ser. No. 62/988,678, filed on Mar. 12, 2020; the disclosure of which is incorporated herein by reference.

TECHNICAL FIELD

The following generally relates to spinning projectiles. More specifically, the following relates to altering a trajectory of a projectile. Specifically, the following relates to altering the trajectory of a projectile in response to a command signal.

BACKGROUND

The orientation of a spinning projectile is critical to its guidance. Rifled projectiles, such as bullets, spin at high speeds (~6 kHz), to stabilize ballistic flight. Unfortunately, the trajectory of a spinning projectile may be altered mid-flight causing the projectile to miss a target.

SUMMARY

For at least the reasons stated herein, there is a continuing unmet need for a system that determines if a projectile is going to miss a target and alters the trajectory of the projectile to place the projectile on a trajectory that will cause the projectile to hit the target.

In one aspect, an exemplary embodiment of the present disclosure may provide a method. The method may include determining a rotational position of a rotating projectile as a function of an orientation of a sensor on the rotating projectile. The method may further include actuating a steering mechanism on the rotating projectile at the determined rotational position. The method may further include altering the trajectory of a rotating projectile. This exemplary embodiment or another exemplary embodiment may provide firing the projectile from a gun; sending a first signal to the projectile, wherein a transmitter operatively coupled with the gun sends the first signal; receiving the first signal with a receiving element of the projectile; and actuating the steering mechanism at the determined rotational position as a function of the first signal. This exemplary embodiment or another exemplary embodiment may provide determining a first angle of deviation between an actual trajectory of the projectile and a desired trajectory of the projectile; and generating the first signal as a function of the first angle of deviation. This exemplary embodiment or another exemplary embodiment may provide wherein the transmitter determines the first angle of deviation and generates the first signal.

This exemplary embodiment or another exemplary embodiment may provide generating the first signal as a function a static correction that accounts for a known delay in actuating the steering mechanism, wherein the transmitter generates the first signal. This exemplary embodiment or another exemplary embodiment may provide wherein the steering mechanism is one of a canard, an aileron, or a piezoelectric fin. This exemplary embodiment or another exemplary embodiment may provide wherein the sensor is one of an accelerometer, an infrared photodiode, a Hall effect sensor, a pressure sensor, a polarized radio frequency antenna, or an optical receiver. This exemplary embodiment or another exemplary embodiment may provide wherein the sensor is a polarized radio frequency antenna and the first signal is a polarized radio signal. This exemplary embodiment or another exemplary embodiment may provide wherein the sensor is an optical receiver and the first signal is a polarized optical signal.

This exemplary embodiment or another exemplary embodiment may provide generating a second signal as a function of the orientation of the sensor, wherein the sensor generates the second signal and wherein the orientation of the sensor correlates to the rotation of the projectile; converting the second signal to a third signal, wherein an operational amplifier on the projectile converts the second signal to the third signal and wherein the third signal is standardized to a semiconductor; and determining the rotational position of the projectile as a function of the third signal, wherein a processor of the projectile determines the rotational position. This exemplary embodiment or another exemplary embodiment may provide scaling the third signal by a scaling factor, wherein the processor scales the third signal; and determining the rotational position as a function of the scaled signal and the third signal, wherein the processor determines the rotational position. This exemplary embodiment or another exemplary embodiment may provide sending a second signal to the projectile, wherein the transmitter connected to the gun sends the second signal; capturing the second signal with the receiving element of the projectile; and actuating the steering mechanism as a function of the second signal. This exemplary embodiment or another exemplary embodiment may provide determining a second angle of deviation; and in response to determining the second angle of deviation is not equal to zero, generating the second signal as a function of the second angle of deviation.

This exemplary embodiment or another exemplary embodiment may provide determining the second angle of deviation as a function of a first location of the projectile and a second location of the projectile. This exemplary embodiment or another exemplary embodiment may provide wherein the projectile is at the first location when the transmitter sends the first signal and wherein the projectile at the second location after the transmitter sends the first signal. This exemplary embodiment or another exemplary embodiment may provide wherein the second angle of deviation is an angle between the desired trajectory of the projectile at the first location and the second location of the projectile. This exemplary embodiment or another exemplary embodiment may provide determining a third angle of deviation; in response to determining the third angle of deviation is not equal to zero, generating a third signal as a function of the third angle deviation; sending the third signal to the projectile; and actuating the steering mechanism as a function of the third signal.

This exemplary embodiment or another exemplary embodiment may provide wherein the transmitter determines the second angle of deviation, determines the third angle of deviation, determines if the third angle of deviation is equal to zero, and sends the third signal to the projectile. This exemplary embodiment or another exemplary embodiment may provide determining the third angle of deviation as a function of a third location of the projectile and a fourth location of the projectile, wherein the projectile is at the third location when the transmitter sends the second signal to the projectile and wherein the projectile is at the fourth location after the transmitter sends the second signal to the projectile. This exemplary embodiment or another exemplary embodiment may provide wherein the third angle of deviation is the angle between the desired trajectory of the projectile

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
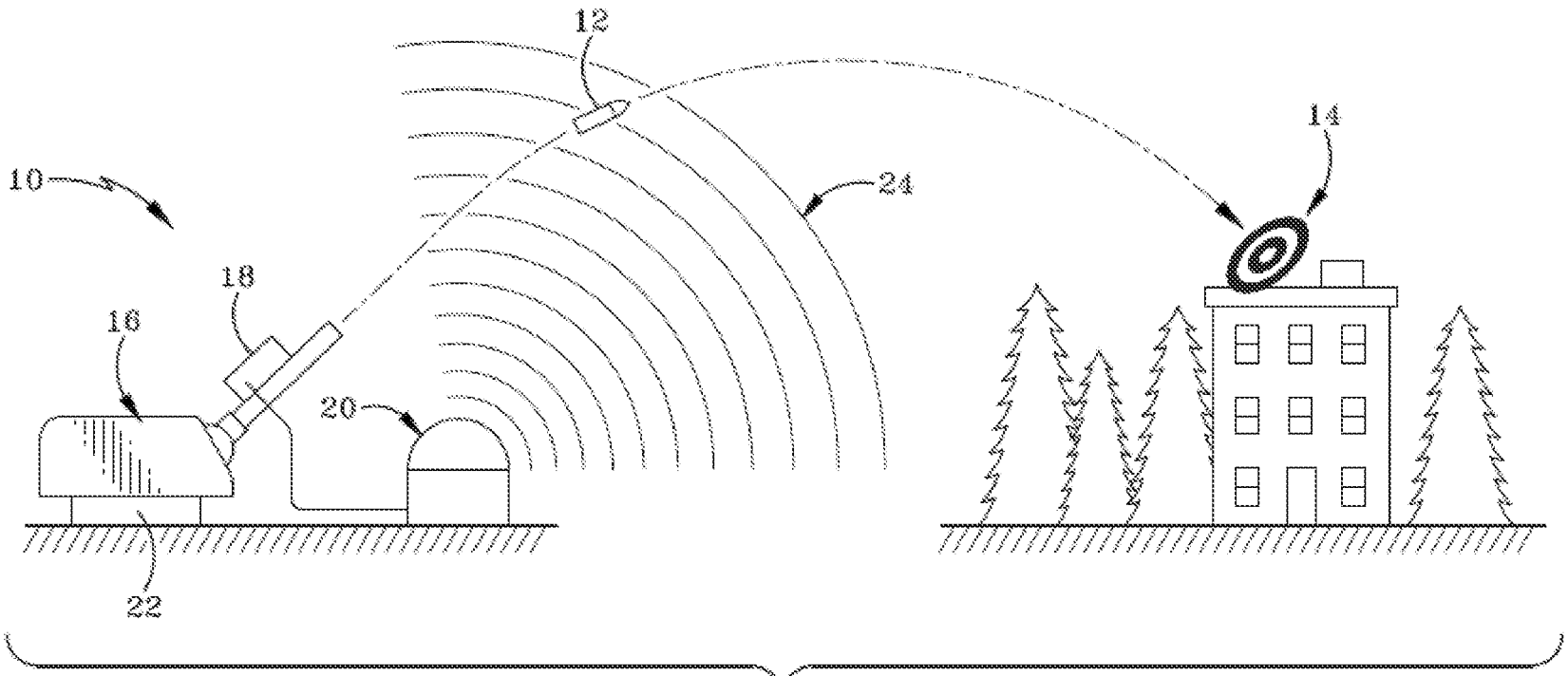
FIG. 1 (FIG. 1) depicts a system for firing a projectile at a target.

FIG. 1 depicts a system 10 for firing a projectile 12 at a target 14. The system 10 includes a gun 16, an optical sensor and camera assembly 18, a fire control electronics and command transmitter 20, and a gimbal 22. The optical sensor and camera assembly 18 includes a camera or other type of image sensor. The gun 16 may be any gun 16 that is capable of firing any caliber of projectile 12. In one example, the gun 16 may be a rifle capable of firing a .50 caliber Browning Machine Gun (BMG) projectile 12. In another example, the gun 16 may be a howitzer capable of firing a 155 millimeter (mm) artillery projectile 12. After the gun 16 fires the projectile 12, the camera of the optical sensor and camera assembly 18 monitors the projectile 12 and the target 14 while the projectile 12 is in flight. In one embodiment, the optical sensor and camera assembly 18 is connected to the gun 16. In this embodiment, the optical sensor and camera assembly 18 may be mounted on the gun 16. In another embodiment, the optical sensor and camera assembly 18 is not connected to the gun 16. In this embodiment, the optical sensor and camera assembly 18 may be at a location that is remote from the gun 16.

The fire control electronics and command transmitter 20 sends signals 24 to the projectile 12. In one embodiment, the signals 24 are radio frequency signals. In another embodiment, the signals 24 are optical signals. As will be discussed in further detail herein, the trajectory of the projectile 12 is altered in response to the signals 24. The fire control electronics and command transmitter 20 is connected to the optical sensor and camera assembly 18. In one embodiment, the fire control electronics and command transmitter 20 is connected to the optical sensor and camera assembly 18 via a wire. In another embodiment, the fire control electronics and command transmitter 20 is wirelessly connected to the optical sensor and camera assembly 18. In this embodiment, the fire control electronics and command transmitter 20 may be at a location that is remote from the optical sensor and camera assembly 18 and the gun 16. The gun 16 is mounted to the gimbal 22. Before the projectile 12 is fired, the gimbal 22 stabilizes the gun 16 and orients the gun 16 towards the target 14.

Figure 2:
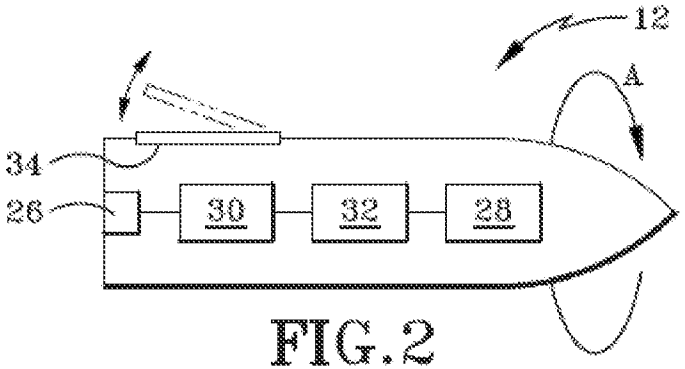
FIG. 2 (FIG. 2) depicts the projectile of FIG. 1.

FIG. 2 depicts a side view of the projectile 12. The projectile 12 includes a sensor 26, a receiving element 28, an operational amplifier 30 a logic 32 and at least one steering mechanism 34. When fired, the projectile 12 rotates in the direction of arrow A.

Figure 3:
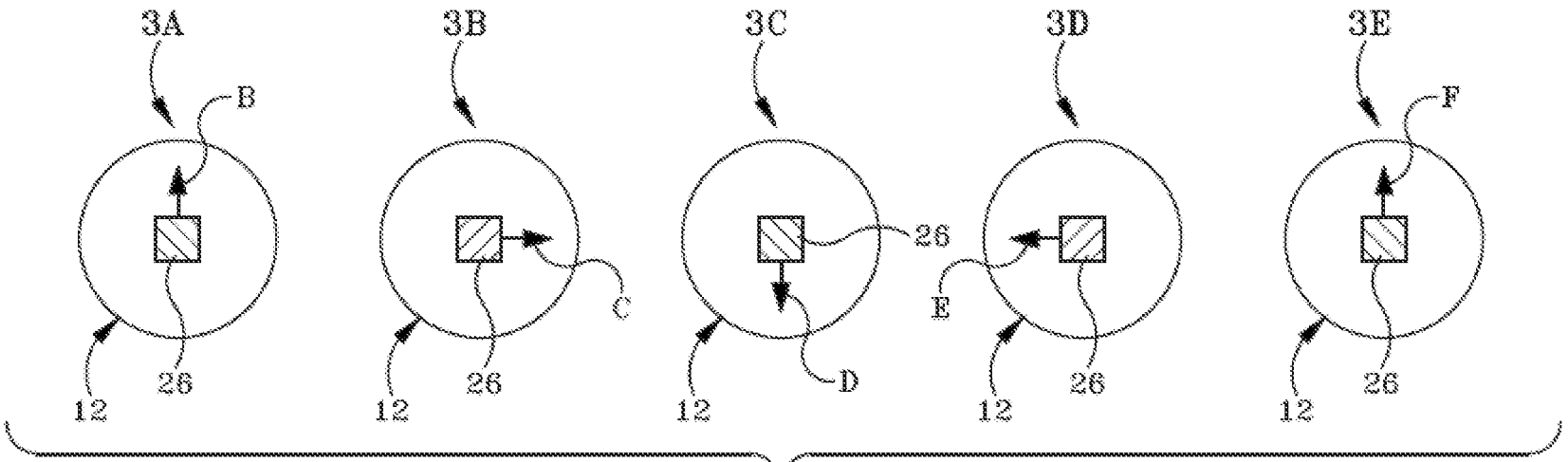
FIG. 3 (FIG. 3) depicts rearview orientations of the projectile of FIG. 1.

FIG. 3 depicts a rear view of the projectile in a first position 3A, a second position 3B, a third position 3C, a fourth position 3D, and a fifth position 3E. As the projectile 12 rotates in the direction of arrow A responsive to being fired or launched from a rifled barrel, the orientation of the projectile 12 and the sensor 26 changes relative to the ground due to the sensor being carried by the projectile. Rotation of the projectile 12 causes the sensor 26 to revolve around a longitudinal axis of the projectile 12. When the projectile 12 rotates from the first position 3A to fifth position 3E, the projectile 12 has completed one revolution. Accordingly, FIG. 3 depicts one revolution of the projectile 12. In the first position 3A, the projectile 12 has rotated 0° and the sensor 26 is oriented in an upward direction as denoted by arrow B. In the second position 3B, the projectile 12 has rotated 90° and the sensor 26 is oriented in a right facing direction as denoted by arrow C. In the third position 3C, the projectile 12 has rotated 180° and the sensor 26 is oriented in a downward direction as denoted by arrow D. In the fourth position 3D, the projectile 12 has rotated 270° and the sensor 26 is oriented in a left facing direction as denoted by arrow E. In the fifth position 3E, the projectile 12 has rotated 360° and the sensor 26 is oriented in a right facing direction as denoted by arrow F.

Figure 4:
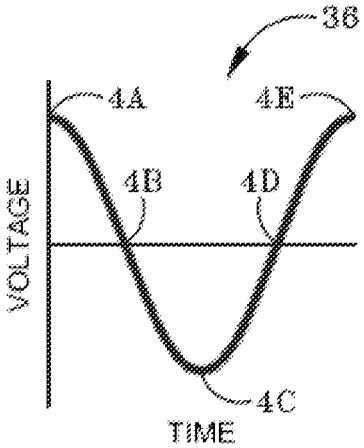
FIG. 4 (FIG. 4) depicts an electrical signal generated by a sensor of the projectile of FIG. 1.

FIG. 4 depicts an embodiment of an electrical signal 36 that is generated by the sensor 26. The signal 36 includes an output voltage from the sensor 26. The sensor 26 generates the signal 36 as a function of its orientation over time. For example, as depicted in FIG. 4, when the projectile 12 is in the first position 3A, the sensor 26 may output a first voltage 4A that corresponds to a 0° rotation of the projectile 12. When the projectile 12 is in the second position 3B, the sensor 26 may output a second voltage 4B that corresponds to a 90° rotation of the projectile 12. When the projectile 12 is in the third position 3C, the sensor 26 may output a third voltage 4C that corresponds to a 180° rotation of the projectile 12. When the projectile 12 is in the fourth position 3D, the sensor 26 may output a fourth voltage 4D that corresponds to a 270° rotation of the projectile 12. When the projectile 12 is in the fifth position 3E, the sensor 26 may output a fifth voltage 4E that corresponds to a 360° rotation of the projectile 12. Accordingly, in this example, the sensor 26 may output a maximum voltage when the sensor is at the first position 3A and the fifth position 3E and may output a minimum voltage when in the third position 3C.

In one embodiment, the sensor 26 may be an accelerometer. In this embodiment, the sensor 26 measures gravity by having an axis in a radial direction. As such, the sensor 26 detects a difference between upward and downward acceleration. In this embodiment, the sensor 26 outputs a maximum voltage when the projectile 12 is in the third position 3C and the sensor 26 is oriented in a downward direction. Accordingly, in this embodiment, the sensor 26 outputs a sinusoid signal 36.

In another embodiment, the sensor 26 may be an infrared (IR) photodiode. In this embodiment, the sensor 26 measures IR emissions from the ground and the sky. The sensor 26 detects a warmer IR emission when oriented toward the ground relative and a colder IR emission when oriented toward the sky as the ground produces a warmer IR emission than the sky. As such, in this embodiment, the sensor 26 outputs a maximum voltage when the projectile 12 is at the third position 3C and the sensor 26 is oriented in a downward direction. Accordingly, in this embodiment, the sensor 26 outputs a square wave signal 36.

In yet another embodiment, the sensor 26 may be a Hall effect sensor. In this embodiment, the sensor measures the magnetic field of the earth to detect a difference between an upward and downward orientation of the sensor 26. In this embodiment, the sensor 26 outputs a sinusoid signal 36. In yet another embodiment, the sensor 26 may be a pressure sensor. In this embodiment, the sensor 26 detects differences in pressure as the projectile 12 rotates. The differences in pressure cause the sensor 26 to output a sinusoid signal 36.

In yet another embodiment, the sensor 26 may be a polarized radio frequency antenna. In this embodiment, the signals 24 sent by the fire control electronics and command transmitter 20 are radio frequency signals that are polarized at a given angle of a standard Cartesian plane. The sensor 26 is polarized at the same angle as the signals 24 sent by the fire control electronics and command transmitter 20. As such, the sensor 26 captures the signals 24 and outputs a maximum voltage when sensor 26 is oriented at the same angle as the signals 24 and a maximum voltage when the sensor 26 is oriented 180° from the given angle. Accordingly, the sensor 26 outputs a sinusoid signal 36 wherein the signal 36 has a period that is half the period of the rotation of the projectile 12 since the signal is maximized at two locations.

In yet another embodiment, the sensor 26 may be an optical receiver. In this embodiment, the signals 24 sent by the fire control electronics and command transmitter 20 are optical signals that are polarized at a given angle of a standard Cartesian plane. The sensor 26 is polarized at the same angle as the signals 24 sent by the fire control electronics and command transmitter 20. As such, the sensor 26 captures the signals 24 and outputs a maximum voltage when sensor 26 is oriented at the same angle as the signals 24 and a maximum voltage when the sensor 26 is oriented 180° from the given angle. Accordingly, the sensor 26 outputs a sinusoid signal 36 wherein the signal 36 has a period that is half the period of the rotation of the projectile 12 since the signal 36 is maximized at two locations.

Other exemplary sensors are entirely possible that could function as sensor 26 to provide the signal 36 needed to identify the rotational orientation of the projectile 12. Other exemplary sensors include gyroscopes sensing movements during angular orientation and/or rotation, and rotation; altimeters sensing barometric pressure, altitude change, local pressure changes, submersion in liquid; impellers measuring the amount of air/fluid passing thereby; Global Positioning sensors sensing location, elevation, distance traveled, velocity/speed; Audio Sensors sensing local environmental sound levels; Photo/Light sensors sensing light intensity which may vary depending on rotation (i.e., counting shadows in frequency dependent intervals); and Temperature sensors sensing surrounding temperature, ambient air temperature, and environmental temperature.

The sensor 26 is connected to the operational amplifier 30. The operational amplifier 30 receives the signal 36 from the sensor 26. The operational amplifier 30 conditions the signal 36 to a standardized clock signal that can be received by a standard complementary metal-oxide-semiconductor of the logic 32. Since the operational amplifier 30 conditions the signal 36 to a standardized clock signal, the sensor 26 may be any sensor 26 that outputs an electrical signal 36 that is generated as a function of the orientation of the sensor 26. Since the signal 36 is determined as a function of the orientation of the sensor 26, and is therefore determined as a function of the rotation of the projectile 12, the clock signal is also determined as a function of the rotation of the projectile 12. The logic 32 is connected to the operational amplifier 30 and receives the clock signal from the operational amplifier 30. The logic 32 processes the clock signal thereby synchronizing the logic 32 to the rotation of the projectile 12.

Figure 5:
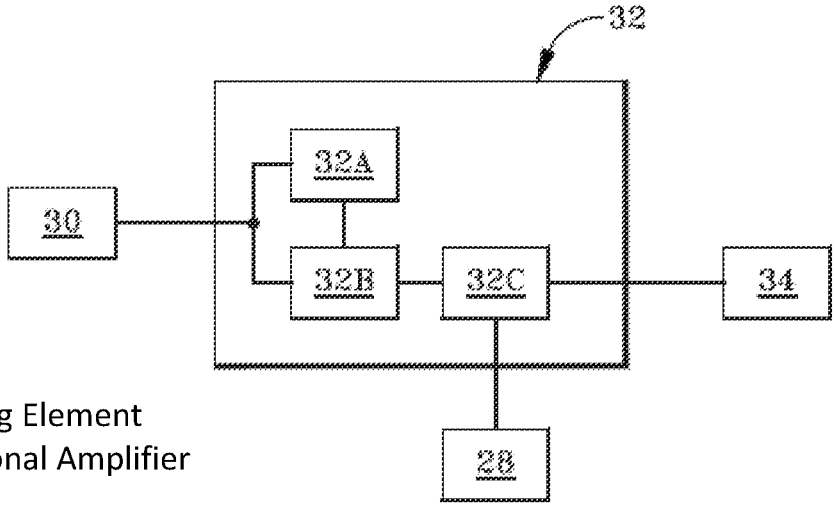
FIG. 5 (FIG. 5) depicts a logic of the projectile of FIG. 1.

FIG. 5 further depicts the logic 32. The logic 32 includes a frequency multiplier unit 32A, a counter 32B, and a comparator 32C. The frequency multiplier unit 32A is connected to the operational amplifier 30 and receives the clock signal from the operational amplifier. The frequency multiplier unit 32A scales the clock signal by a given scaling factor and outputs a scaled signal. Each period of the scaled signal correlates to the temporal phase of the signal 36 and the clock signal. Furthermore, each period of the scaled signal correlates to a physical phase of the rotation of the projectile 12.

In one example, the sensor 26 is an IR photodiode and the scaling factor is 360. In this example, each period of the scaled signal correlates to 1° of temporal phase of the signal 36 and the clock signal and correlates to 1° of rotation of the projectile 12. Accordingly, when the scaled signal includes 360 periods, the projectile 12 has completed one revolution. In another example, the sensor 26 is an accelerometer and the scaling factor is 180. In this example, each period of the scaled signal correlates to 2° of temporal phase of the signal 36 and the clock signal and correlates to 2° of rotation of the projectile 12. Accordingly, when the scaled signal includes 180 periods, the projectile 12 has completed one revolution.

In yet another example, the sensor 26 is an accelerometer the scaling factor is 36. In this example, each period of the scaled signal correlates to 10° of temporal phase of the signal 36 and the clock signal and correlates to 10° of rotation of the projectile 12. Accordingly, when the scaled signal includes 36 periods, the projectile 12 has completed one revolution. In yet another example, the sensor 26 is an optical receiver and the scaling factor is 18. In this example, each period of the clock signal correlates to 180° of rotation of the projectile 12. As such, each period of rotation of the scaled signal correlates to 10° of temporal phase of the signal 36 and the clock signal and correlates to 10° of rotation of the projectile 12. Accordingly, when the scaled signal includes 36 periods, the projectile 12 has completed one revolution.

Furthermore, the scaled signal includes a scaled frequency that correlates to the frequency of the clock signal. The frequency multiplier unit 32A scales the frequency of the clock signal by the scaling factor. The output scaled signal includes the scaled frequency.

In one example, the frequency of the clock signal is 300,000 revolutions per minute (rpm) or 5 kilohertz (kHz) and the scaling factor is 360. Accordingly, the frequency multiplier unit 32A outputs a scaled signal with a frequency of 1,800 kHz or 1.8 megahertz (MHz). In another example, the frequency of the clock signal is 600,000 rpm or 10 kHz and the scaling factor is 180. Accordingly, frequency multiplier unit 32A outputs a scaled signal with a frequency of 1,800 kHz or 1.8 (MHz). In yet another example, the determined period is 400,000 rpm or $6.\overline{66}$ kHz and the scaling factor is 36. Accordingly, the frequency multiplier unit 32A outputs a scaled signal with a frequency of 240 kHz or 0.24 MHz.

The counter 32B is connected to the frequency multiplier unit 32A. The counter 32B receives the scaled signal and the scaled frequency from the frequency multiplier unit 32A. The counter 32B is further connected to the operational amplifier 30. The counter 32B receives the clock signal from the operational amplifier 30. The counter 32B counts a number of maximum voltages in the scaled signal between a first maximum voltage of the operational amplifier and a second maximum voltage of the operational amplifier. That is, the counter 32B counts a number of periods of the scaled signal between periods of the clock signal. The counter 32B resets its count to 0 after each period of the clock signal or after two periods of the clock signal. Since the scaled signal correlates to the clock signal and the clock signal correlates to the signal 36 from the sensor 26 which correlates to the orientation of the sensor 26, the output count correlates to a rotation of the projectile 12.

In one example, the sensor 26 is an accelerometer and as such, the clock signal includes a maximum voltage and the count is reset when the projectile 12 is in the third position 3C. In this example, the scaled signal has a period of 144 kHz or 0.144 MHZ and the scaling factor is 36. That is, the scaled signal includes 36 periods for every rotation of the projectile 12. Hence the counter 32B counts from 0 to 36 for every rotation of the projectile 12. In this example, the counter 32B increases the count by one every 0.25 milliseconds (ms) or once every 250 microseconds (μs) as the scaled signal completes a cycle once every 0.25 ms or once every 250 μs. Accordingly, in this example, when the projectile 12 has rotated 90° from the third position 3C to the fourth position 3D, the counter 32B outputs a count of 9 2.25 ms after the counter 32B was reset.

In another example, the sensor 26 is an IR photodiode and as such, the clock signal includes a maximum voltage and the count is reset when the projectile 12 is in the third position 3C. In this example, the scaled signal has a period of 432 kHz and the scaling factor is 72. That is, the scaled signal includes 72 periods for every rotation of the projectile 12. Hence, the counter 32B counts from 0 to 72 for every rotation of the projectile 12. In this example the counter 32B increases the count by one every $0.1\overline{66}$ ms as the scaled signal completes a cycle once every $0.1\overline{66}$ ms. Accordingly, in this example, when the projectile 12 has rotated 270° from the third position 3C to the second position 3B, the counter 32B outputs a count of 54 9 ms after the counter 32B was reset.

In yet another example, the sensor 26 is an accelerometer and as such, the clock signal includes a maximum voltage and the count is reset when the projectile 12 is in the third position 3C. In this example, the scaled signal has a period of 1.8 MHz and the scaling factor is 360. That is, the scaled signal includes 360 periods for every rotation of the projectile 12. Hence, the counter 32B counts from 0 to 360 for every rotation of the projectile 12. In this example the counter 32B increases the count by one every $0.\overline{55}$ μs as the scaled signal completes a cycle once every $0.\overline{55}$ μs. Accordingly, in this example, when the projectile 12 has rotated 90° from the third position 3C to the fourth position 3D, the counter 32B outputs a count of 90 50 μs after the counter 32B was reset.

In yet another example, the sensor 26 is a polarized radio frequency antenna that is polarized at 0° of a standard Cartesian plane and as such, the clock signal includes a maximum voltage and is reset when the projectile 12 is in the first position 3A. In this example the scaled signal has a period of 54 kHz and the scaling factor is 18. That is, the scaled signal includes 18 periods for every rotation of the projectile 12. Hence, the counter 32B counts from 0 to 18 for every rotation of the projectile 12. In this example, the counter 32B increases the count by one every $0.\overline{66}$ ms as the scaled signal completes a cycle once every $0.\overline{66}$ ms. Accordingly, in this example when the projectile 12 has rotated 60° from the first position 3A or 60° from the third position, the counter 32B outputs a count of 12.

The comparator 32C is connected to the receiving element 28. The receiving element 28 captures the signal 24 from the fire control electronics and command transmitter 20 and sends an instruction signal that is indicative of the signal 24 to the comparator 32C. The signal 24, and therefore the instruction signal, may include actuating the steering mechanism 34 when the projectile 12 has rotated to a given position. The comparator 32C is further connected to the counter 32B. The comparator 32C receives the count from the counter 32B. The comparator 32C compares the count to the instruction signal. When the count equals the position wherein the steering mechanism 34 is to be actuated, the comparator 32C outputs a command signal to actuate the steering mechanism 34.

In one example, the sensor 26 is an accelerometer. In this example, the counter 32B resets and begins counting when the projectile 12 is at the third position 3C. Furthermore, in this example, the scaling factor is 72 and the command signal includes actuating the steering mechanism 34 when the projectile 12 is at the fourth position 3D. When the count equals 18, the projectile 12 has rotated 90° from the third position 3C and is at the fourth position 3D. Accordingly, when the comparator 32C receives a count from the counter 32B that is 18, the comparator 32C outputs the command signal.

In another example, the sensor 26 is an IR photodiode. In this example, the counter 32B resets and begins counting when the projectile 12 is at the third position 3C. Furthermore, in this example, the scaling factor is 360 and the command signal includes actuating the steering mechanism 34 when the projectile 12 has rotated 227° from the third position 3C. When the count equals 227, the projectile 12 has rotated 227° from the third position 3C. Accordingly, when the comparator 32C receives a count from the counter 32B that is 227, the comparator 32C outputs the command signal.

In yet another example, the sensor 26 is an optical receiver that is polarized at 0° of a standard Cartesian plane. In this example, the counter 32B retests and begins counting when the projectile 12 is at the first position 3A. Furthermore, in this example, the scaling factor is 360 and the command signal includes actuating the steering mechanism 34 when the projectile 12 has rotated 32° from the first position 3A. When the count equals 32, the projectile 12 has rotated 32° from the first position 3A. Accordingly, when the comparator 32C receives a count from the counter 32B that is 32, the comparator 32C outputs the command signal.

The steering mechanism 34 includes an actuator and is connected to the comparator 32C. The steering mechanism 34 receives the command signal from the comparator 32C and is actuated by the actuator that moves in response to the command signal. The steering mechanism 34 may be a canard, an aileron, a piezoelectric fin, or another mechanism that alters the aerodynamics of the projectile 12. Altering the aerodynamics of the projectile 12 may alter the trajectory of the projectile 12. For example, when the steering mechanism 34 is an aileron, the command signal from the comparator 32C actuates piezoelectric transducers to raise or lower the aileron thereby creating more or less drag at a specific moment in the rotation of the projectile 12 thereby altering the trajectory of the projectile 12.

Figure 8:
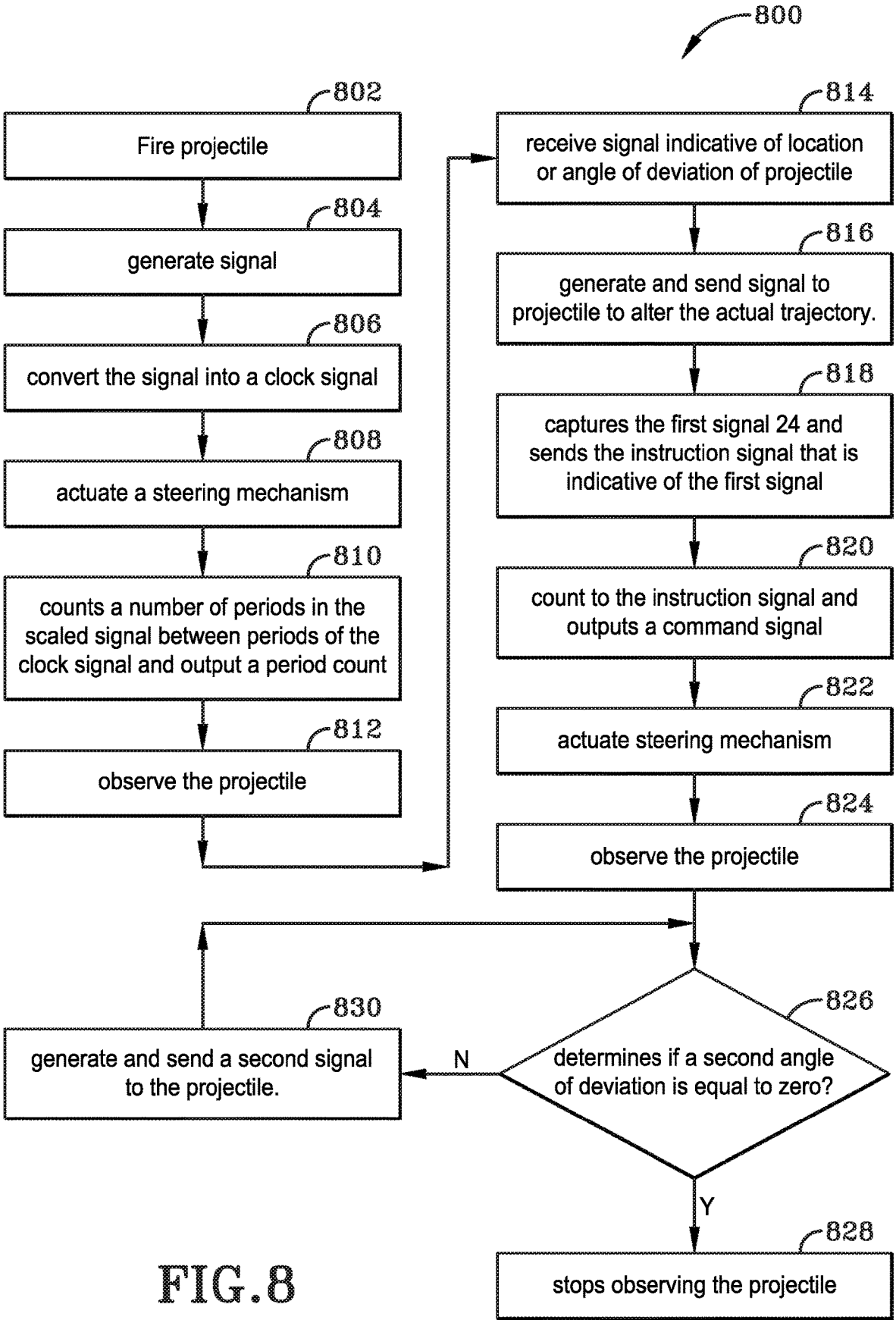
FIG. 8 (FIG. 8) depicts a system or method for altering the trajectory of a projectile.

FIG. 8 depicts a system or method 800 for altering the trajectory of the projectile 12. At 802, the gun 16 of the system 10 fires the projectile 12 at the target 14. At 804, the sensor 26 of the projectile 12 generates the signal 36 as a function of the orientation of the sensor 26 as described herein. At 806, an operational amplifier 30 receives the signal 36 from the sensor 26 and converts the signal 36 to a clock signal as described herein. At 808, a processor that is configured to automatically actuate the steering mechanism 34 (the "configured processor") that receives the clock signal and scales the clock signal by a given factor and outputs a scaled signal as described herein. At 810, the configured processor counts a number of periods in the scaled signal between periods of the clock signal and outputs a period count as described herein.

Figure 6:
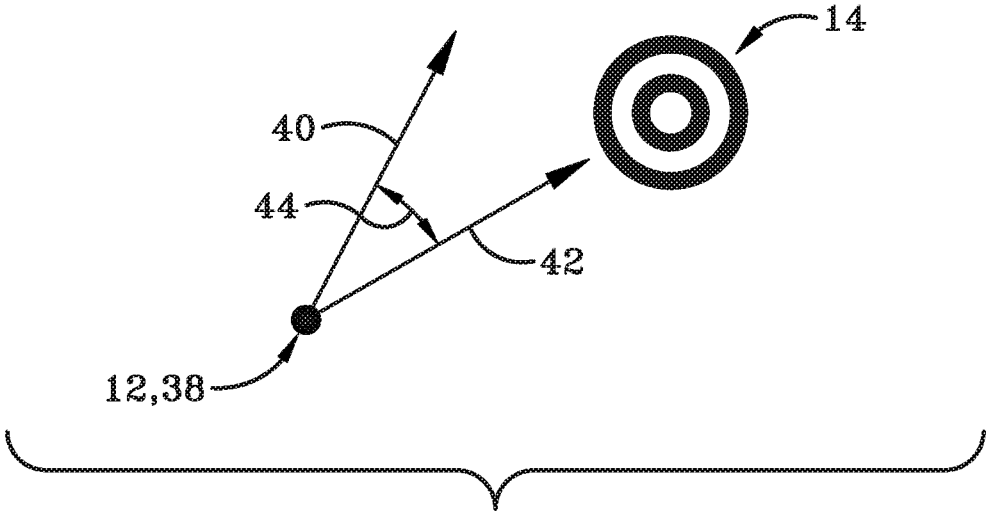
FIG. 6 (FIG. 6) depicts the projectile of FIG. 1 at a first position relative to the target of FIG. 1.

At 812, the optical sensor and camera assembly 18 observes the projectile 12 and the target 14 while the projectile 12 is in flight. Briefly turning to FIG. 6, the optical sensor and camera assembly 18 observes the projectile 12 at a first location 38 and the target 14. The projectile 12 has an actual trajectory 40. In this example, if the projectile 12 continues to follow the actual trajectory 40, the projectile 12 will miss the target 14. FIG. 6 further depicts a desired trajectory 42. If the projectile 12 follows the desired trajectory 42, the projectile 12 will hit the target 14. There is a first angle of deviation 44 between the actual trajectory 40 and the desired trajectory 42. Returning to FIG. 5, at 814, the fire control electronics and command transmitter 20 receives a signal indicative of the first location 38 of the projectile 12 relative to the target 14 and determines the first angle of deviation 44 between the actual trajectory 40 of the projectile 12 at the first location 38 relative to the desired trajectory 42 of the projectile 12, wherein the desired trajectory 42 is towards the target 14. The fire control electronics and command transmitter 20 determines the first angle of deviation 44 as a function of the signal indicative of the first location 38 relative to the target 14.

At 816, the fire control electronics and command transmitter 20 generates and sends a first signal 24 to the projectile 12 to alter the actual trajectory 40 as a function of the first angle of deviation 44. The first signal 24 includes instructions to actuate the steering mechanism 34 of the projectile 12 at specific times in the rotation of the projectile 12 as described herein. Actuating the steering mechanism 34 at the specific times alters the actual trajectory 40 as a function of the first angle of deviation 44. In one example, the fire control electronics and command transmitter 20 may determine the first angle of deviation 44 is 45° relative to a standard Cartesian plane. In this example, the first signal 24 includes instructions to actuate the steering mechanism 34 at times in the rotation of the projectile 12 that will cause the projectile 12 to alter its trajectory by 45°. In another example, the fire control electronics and command transmitter 20 may determine the first angle of deviation 44 is 35° relative to a standard Cartesian plane. In this example, the first signal 24 includes instructions to actuate the steering mechanism 34 at times in the rotation of the projectile 12 that will cause the projectile 12 to alter its trajectory by 35°.

The first signal 24 may further include instructions to actuate the steering mechanism 34 of the projectile 12 as a function of a static correction that accounts for known delays when altering the trajectory of the projectile 12. The known delays may include delays in sending or receiving the first signal 24, delays in activating the steering mechanism 34, etc. If these delays are not accounted for, the trajectory of the projectile 12 may be altered in an unpredictable manner in response to the first signal 24. For example, the first signal 24 may include instructions alter the trajectory of the projectile 12 by 55°. In this example, the first signal 24 may not account for known delays and, in response to the first signal 24, the trajectory of the projectile 12 may be altered by 45°. In another example, the first signal 24 may include instructions to alter the trajectory of the projectile 12 by 65°. In this example, the first signal 24 may account for the known delays and, in response to the first signal 24, the trajectory of the projectile 12 may be altered by 65°.

At 818, the receiving element 28 of the projectile 12 captures the first signal 24 and sends the instruction signal that is indicative of the first signal 24 to the configured processor as described herein. At 820, the configured processor compares the count to the instruction signal and outputs a command signal as described herein. At 822, the steering mechanism 34 receives the command signal and actuates the steering mechanism 34 as described herein. Since the steering mechanism 34 may be actuated at any point in the rotation of the projectile 12, the steering mechanism 34 may create drag at any point in the rotation of the projectile 12. As such, the steering mechanism 34 may alter the trajectory of the projectile 12 in any direction, including up and down, in response to the signals 24.

Figure 7:
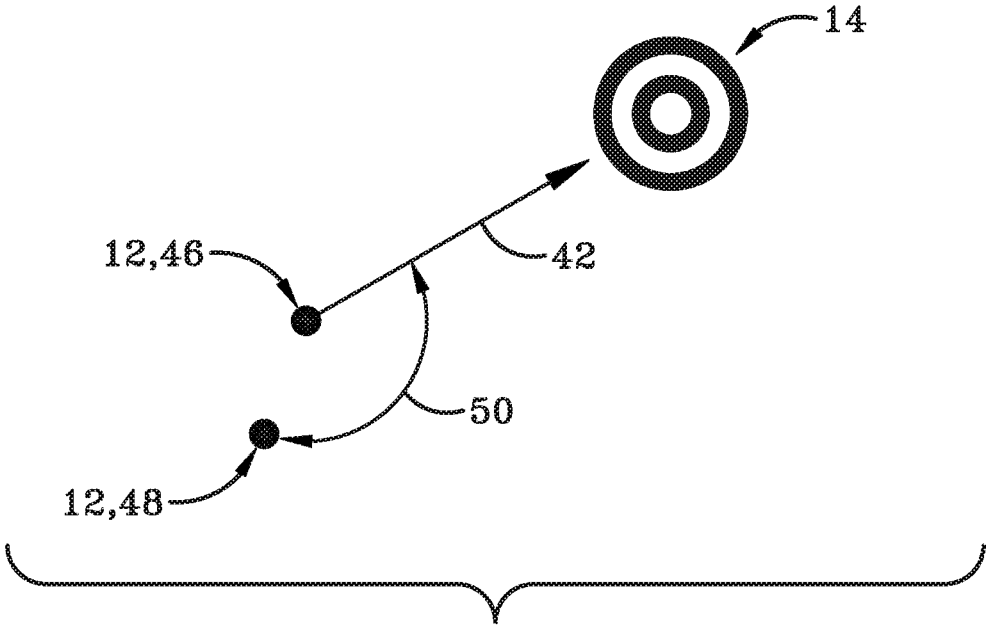
FIG. 7 (FIG. 7) depicts the projectile of FIG. 1 at a second position and a third position relative to the target of FIG. 1.

At 824, as depicted in FIG. 7, the optical sensor and camera assembly 18 observes the projectile 12 at a second location 46, wherein the second location 46 corresponds to the instant that the fire control electronics and command transmitter 20 sent the first signal 24 to the projectile 12 and observes the projectile 12 at a third location 48, wherein the third location 48 corresponds to an instant sometime after the fire control electronics and command transmitter 20 sent the first signal 24 to the projectile 12. Furthermore, at 824, the configured processor determines a second angle of deviation 50. The second angle of deviation 50 is the angle between the desired trajectory 42 when the projectile 12 is at the second location 46 and the location of the projectile 12 at the third location 48 relative to a standard Cartesian plane, wherein the origin of the standard Cartesian plane corresponds to the second location 46 of the projectile 12. The second angle of deviation 50 may be due to variance between projectiles 12. That is, a first projectile 12 may react differently to the first signal 24 than a second projectile 12 due to variances in production of the first projectile 12 and the second projectile 12. The second angle of deviation 50 may be due to environmental factors (i.e., wind) or may be due to noise within the sensor 26 or the logic 32 that may cause the projectile 12 to react differently than expected in response to a signal 24.

At 826, the fire control electronics and command transmitter 20 determines if the second angle of deviation 50 is equal to zero. If the second angle of deviation 50 is equal to zero, then the system or method 800 proceeds to 828. If the second angle of deviation 50 is not equal to zero, then the system or method 800 proceeds to 830. At 828, the optical sensor and camera assembly 18 stops observing the projectile 12 and the projectile 12 continues towards the target 14.

At 830, the fire control electronics and command transmitter 20 generates and sends a second signal 24 to the projectile 12. The second signal 24 includes instructions to actuate the steering mechanism 34 at specific times in the rotation of the projectile 12 to alter the trajectory of the projectile 12 to the desired trajectory 42. The second signal 24 includes instructions to actuate the steering mechanism 34 of the projectile 12 as a function of a dynamic correction that accounts for the second angle of deviation 50. Accounting for the second angle of deviation 50 allows the fire control electronics and command transmitter 20 to send signals 24 that cause the projectile 12 to respond in a more predictable manner. In one example, the desired trajectory 42 may be a 45° trajectory relative to a standard Cartesian plane. In this example, after actuating the steering mechanism 34 in response to the first signal 24, the projectile 12 may be at the third location 48, wherein the third location 48 has a second angle of deviation 50 of 155°. Accordingly, the second signal 24 accounts for a 155° second angle of deviation 50. In another example, the desired trajectory 42 may be a 35° relative to a standard Cartesian plane. In this example, after actuating the steering mechanism 34 in response to the first signal 24, the projectile 12 may be at the third location 48, wherein the third location 48 has a second angle of deviation 50 of 90°. Accordingly, the second signal 24 accounts for a 90° second angle of deviation 50. After sending the second signal 24 to the projectile 12, the system or method 800 proceeds to 826. Accordingly, the system or method 800 may iteratively correct for a second angle of deviation 50. Iteratively correcting for the second angle of deviation 50 allows the system fire control electronics and command transmitter 20 to dynamically control the trajectory of the projectile 12 in a predictable manner.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A method comprising:

firing a projectile from a firing mechanism;

sending, from a transmitter operatively connected to the firing mechanism, a first signal to the projectile, wherein the first signal includes instructions to actuate a steering mechanism of the projectile at a rotational given position of the projectile;

determining, with a processor on the projectile, that the projectile is at the given rotational position as a function of an orientation of a sensor on the rotating projectile;

actuating a steering mechanism on the rotating projectile at the given rotational position; and generating a second signal as a function of the orientation of the sensor, wherein the sensor generates the second signal and wherein the orientation of the sensor correlates to the rotation of the projectile;

converting the second signal to a third signal, wherein an operational amplifier on the projectile converts the second signal to the third signal and wherein the third signal is standardized to a semiconductor; and determining the rotational position of the projectile as a function of the third signal, wherein a processor of the projectile determines the rotational position.

2. The method of claim 1, further comprising:

determining a first angle of deviation between an actual trajectory of the projectile and a desired trajectory of the projectile; and generating the first signal as a function of the first angle of deviation.

3. The method of claim 2, wherein the transmitter determines the first angle of deviation and generates the first signal.

4. The method of claim 2, wherein the sensor is an optical receiver and the first signal is a polarized optical signal.

5. The method of claim 2, further comprising:

sending a second signal to the projectile, wherein the transmitter connected to the gun sends the second signal;

capturing the second signal with the receiving element of the projectile; and actuating the steering mechanism as a function of the second signal.

6. The method of claim 5, further comprising:

determining a second angle of deviation; and in response to determining the second angle of deviation is not equal to zero, generating the second signal as a function of the second angle of deviation.

7. The method of claim 6, further comprising:

determining the second angle of deviation as a function of a first location of the projectile and a second location of the projectile.

8. The method of claim 7, wherein the projectile is at the first location when the transmitter sends the first signal and wherein the projectile is at the second location after the transmitter sends the first signal.

9. The method of claim 7, wherein the second angle of deviation is an angle between the desired trajectory of the projectile at the first location and the second location of the projectile.

10. The method of claim 6 further comprising:

determining a third angle of deviation;

in response to determining the third angle of deviation is not equal to zero, generating a third signal as a function of the third angle deviation;

sending the third signal to the projectile; and actuating the steering mechanism as a function of the third signal.

11. The method of claim 10, wherein the transmitter determines the second angle of deviation, determines the third angle of deviation, determines if the third angle of deviation is equal to zero, and sends the third signal to the projectile.

12. The method of claim 10, further comprising:

determining the third angle of deviation as a function of a third location of the projectile and a fourth location of the projectile, wherein the projectile is at the third location when the transmitter sends the second signal to the projectile and wherein the projectile is at the fourth location after the transmitter sends the second signal to the projectile.

13. The method of claim 12, wherein the third angle of deviation is the angle between the desired trajectory of the projectile at the third position and the fourth position of the projectile.

14. The method of claim 1, further comprising:

generating the first signal as a function of a static correction that accounts for a known delay in actuating the steering mechanism, wherein the transmitter generates the first signal.

15. The method of claim 1, wherein the steering mechanism is one of a canard, an aileron, or a piezoelectric fin.

16. The method of claim 1, wherein the sensor is one of an accelerometer, an infrared photodiode, a Hall effect sensor, a pressure sensor, a polarized radio frequency antenna, or an optical receiver.

17. The method of claim 16, wherein the sensor is a polarized radio frequency antenna and the first signal is a polarized radio signal.

18. The method of claim 1, further comprising:

scaling the third signal by a scaling factor, wherein the processor scales the third signal; and determining the rotational position as a function of the scaled signal and the third signal, wherein the processor determines the rotational position.

19. A system comprising:

a firing mechanism;

a transmitter operatively connected to the firing mechanism; and a projectile with a processor, a sensor, and operational amplifier, and a steering mechanism, wherein the transmitter is configured to send a first signal that includes instructions to actuate the steering mechanism at a given rotational position of the projectile to the projectile, wherein the sensor is configured to generate a second signal, wherein the second signal is a function of the orientation of the sensor and wherein the orientation of the sensor correlates to the rotation of the projectile;

wherein the operational amplifier is configured to convert the second signal to a third signal and wherein the third signal is standardized to a semiconductor;

wherein the processor is configured to determine the rotational position of the projectile as a function of the first signal generated by the sensor, wherein the steering mechanism is configured to actuate at the given rotational position in response to the first signal; and wherein the processor is configured to determine the rotational position of the projectile as a function of the third signal.

* * * * *